United States Patent [19]

Levites

[11] Patent Number: 4,624,110

[45] Date of Patent: Nov. 25, 1986

[54] FLUID POWERED TURBINE

[76] Inventor: Harry H. Levites, 309 S. Washington Dr., Sarasota, Fla. 33577

[21] Appl. No.: 735,126

[22] Filed: May 17, 1985

[51] Int. Cl.[4] ..... F01K 7/00

[52] U.S. Cl. ..... 60/670; 60/677; 415/183; 415/191; 415/101

[58] Field of Search ..... 60/652, 662, 670, 677; 415/44, 45, 183, 184, 198.1, 199.1, 95, 101, 103

[56] References Cited

U.S. PATENT DOCUMENTS 955,165 6/1911 MacDonald ..... 60/677

*Primary Examiner*—Allen M. Ostrager

*Attorney, Agent, or Firm*—Head, Johnson & Stevenson

[57] ABSTRACT

A turbine/power transmission system using pressure fluid, i.e., steam to selectively drive one of a plurality of turbine wheels depending upon the power/torque output and rotary direction required of an output shaft.

4 Claims, 3 Drawing Figures

FLUID POWERED TURBINE

BACKGROUND OF THE INVENTION

This invention is directed to the general field of power plants, and in particular, to steam powered turbine-type powered plants.

In recent days a great clamor as appeared both from the governmental regulatory purposes and a public outcry to find economical means to utilize fossil fuels and to achieve the greatest amount of power therefrom, while at the same token reducing air and noise pollution and to provide apparatus that would be of miniminal maintenance for possible use as a domestic power plant for home electrical generation and as a means to power vehicles for transportation.

Until this invention there is no known means for providing a variable power steam turbine and power transmission system adaptable to a variety of power output requirements and that would meet the current conditions aforesaid.

SUMMARY OF THE INVENTION

It is therefore an object of this invention to provide a steam turbine power plant system that would be economical to operate within minimum of air and noise pollution and maintenance requirements.

A further object of the invention is to provide a power train that will give various ratio of power output per foot pound of steam energy input. This is accomplished by this invention by providing a plurality of stepped up or turbine stages wherein the steam power may be shifted to various diameter turbine wheels to meet the needed output torque or power requirements.

Specifically the concepts of this invention are accomplished by a steam turbine power plant that includes one or a plurality of steam turbine wheels. Each turbine wheel has a plurality of blades thereon which are spaced from and attached outwardly from a power shaft axially located in the turbine. The turbine blades are formed from a part of a sinusoidal curve having a concave portion against which the steam nozzle is directed.

Pressure steam passes through a nozzle into contact with the blades and thence into openings therebetween in a hollow shaft and thence through the shaft to a closed indirect heat exchanger which reforms said exhaust steam and any needed make-up to its original pressure and temperature condition with the output therefrom being returned to the steam nozzle. The output shaft of the turbine can then be connected to an electrical generating means and/or used to power a vehicle.

In one embodiment, a plurality of steam turbine wheels of various diameters are provided and attached to the output shaft. Means are provided to move the steam nozzle selectively opposite the desired turbine wheel for providing the desired power-torque output and/or the nozzle may be shifted from one turbine of one diameter to subsequent turbines of smaller diameters and/or vice versa. Thus the device operates as a variable power transmission.

Before explaining the present invention, in detail, it is to be understood that the invention is not limited in its application to the details of construction and arrangement of parts illustrated in the accompanied drawings, since the invention is capable of other embodiment and being practiced or carried out in a variety of ways. Also, it is to be understood that the phraseology or terminology employed herein is for the purpose for description and not of limitation.

Figure 1:
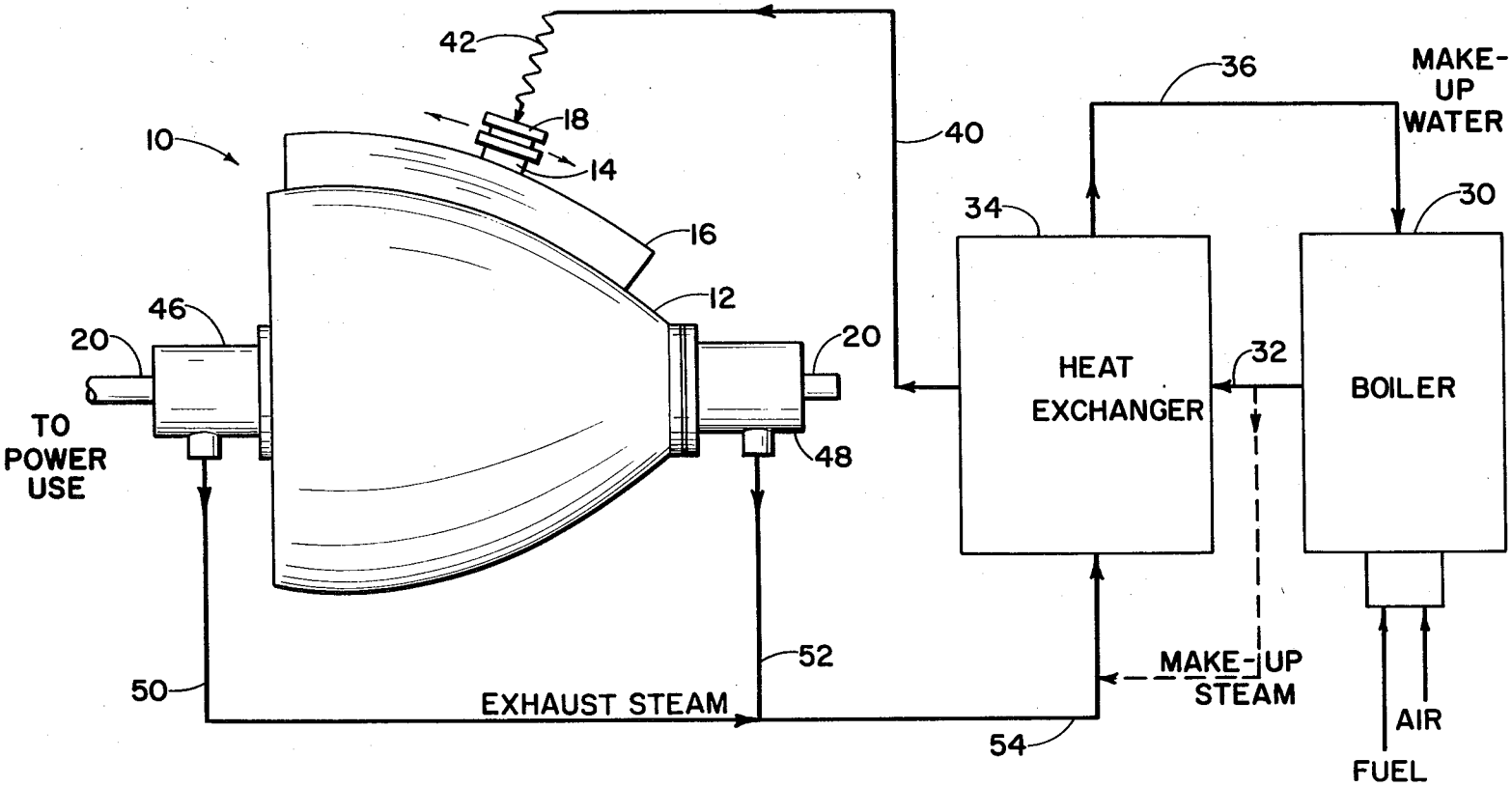
FIG. 1 is a schematic view of the steam powered turbine system of this invention.
Figure 2:
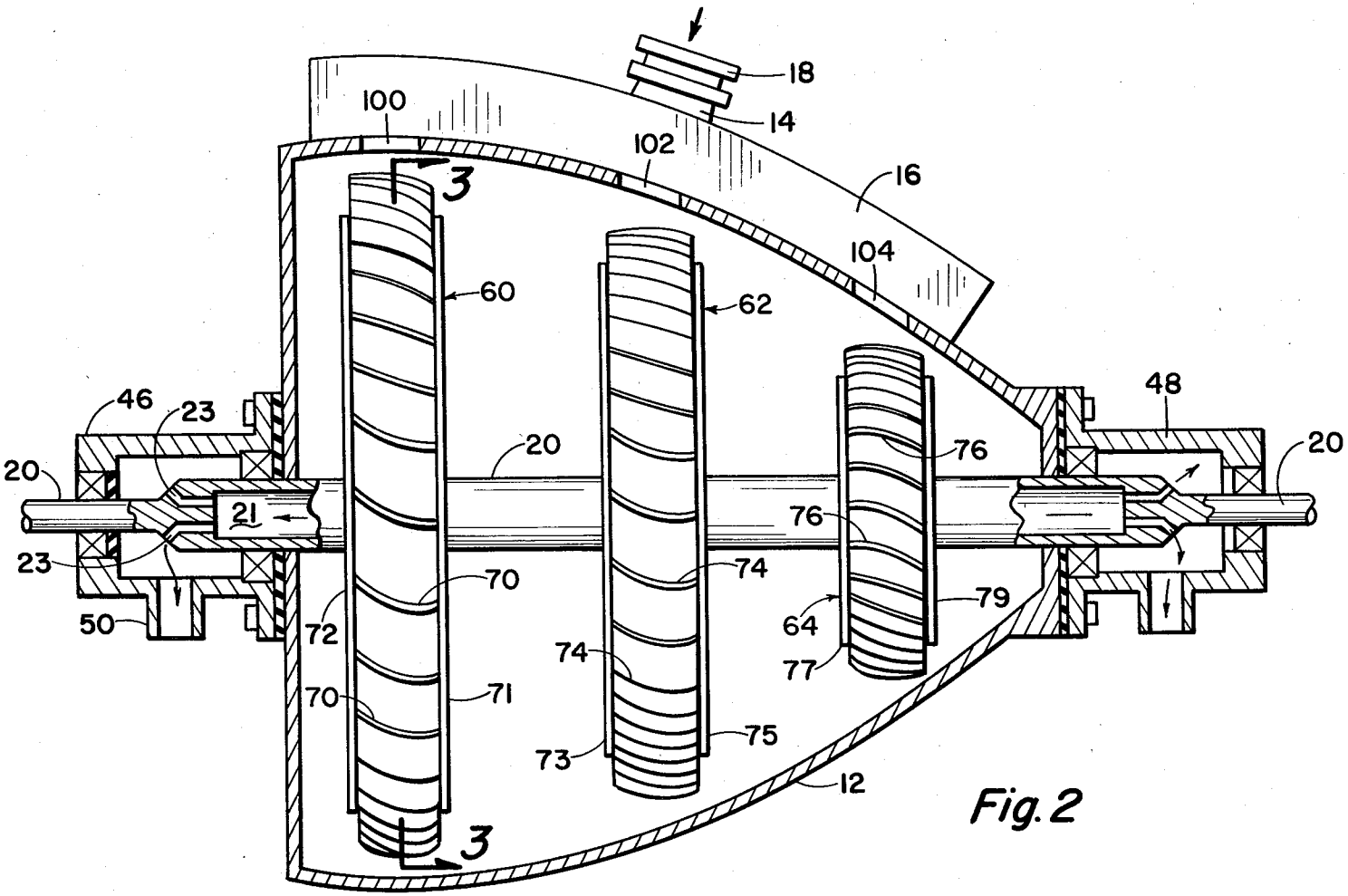
FIG. 2 is a sectional view of the steamed powered turbine of this invention.

Referring now to FIG. 1 the turbine of this invention is generally designated by the numeral 10, and includes a housing 12, the details of which are more aptly described in the cross-sectional view of FIG. 2. A turbine nozzle 14 is slidably retained by a housing 16 by means, not shown, connectable to a collar 18, so as to be movable by a shift lever into operative position with one or a plurality of turbine blade wheels 60, 62 and 64, via ports 100, 102, and 104, respectively, within the housing 12. The power output shaft 20 from the turbine housing is hollow and rotatably land sealably retained thereto.

Figure 3:
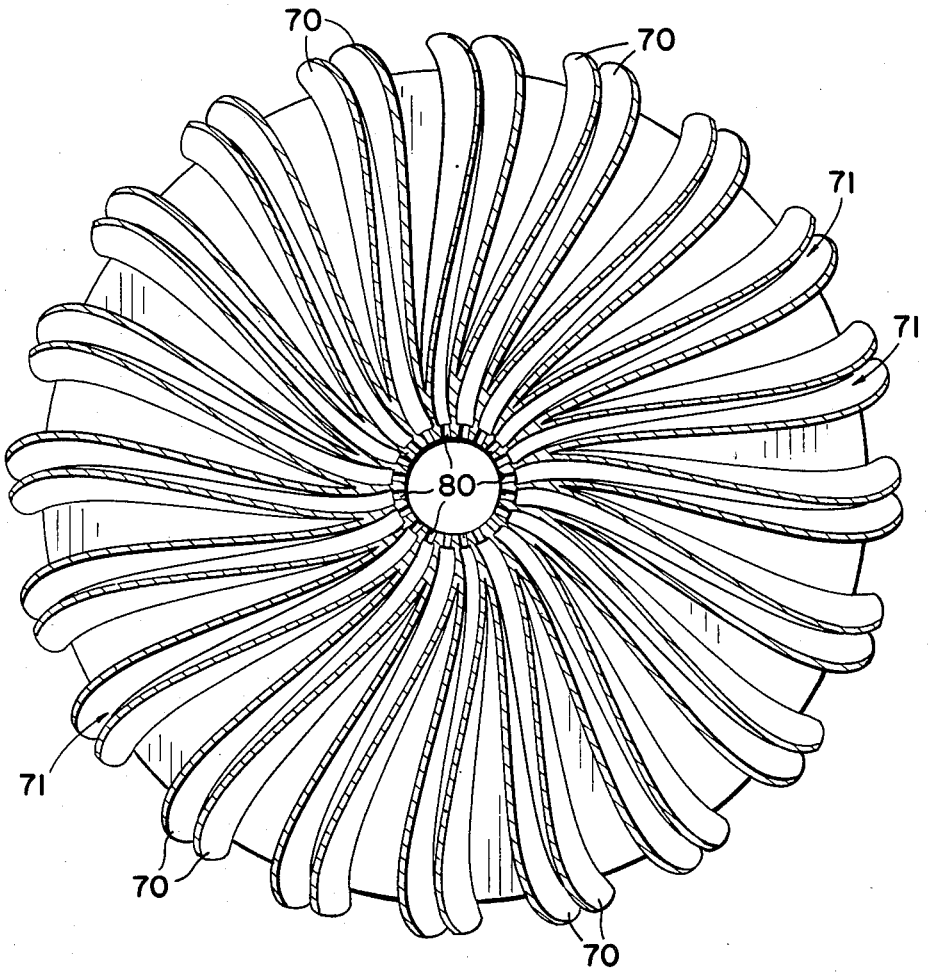
FIG. 3 is a sectional view of the turbine blades as taken along the lines 3—3 of FIG. 2.

Steam for the system is created by a fueled boiler 30 which creates high temperature and high pressure steam though line 32 to an indirect heat exchanger 34. The exhaust steam therefrom exhausting by way of conduit 36 back to the boiler 30. The boiler may be of a well known type to those skilled in the art. The indirect heat exchanger includes a fluid, i.e. steam, output by way of line 40 which interconnects by way of a flexible line 42 to the turbine nozzle 14. The flow of power fluid which is shown in FIGS. 2 and 3 occurs by the steam striking the turbine blades 70 and then exhausting through openings 80 into the shaft 20 to the interior thereof which is thereafter exhausted into one or more manifolds 46 and 48 by way of respective conduits 50 and 52 into the exhaust steam line 54 back to the heat exchanger or to the boiler where the process is repeated or continued.

Referring now to FIG. 2, greater detail of the turbine of this invention is shown. Within housing 12 are one or a plurality of turbine wheels 60, 62 and 64, of desired diameter relative to a desired power/torque output.

Turbine wheel 64 is representative of a reverse direction, i.e., orienting the blades thereon in a direction such that when the nozzle is in position there opposite the shaft 20 will rotate in an opposite direction. It is to be understood, however, that a variety of arrangements of various turbine wheels are inclusive of this invention.

What is claimed is:

1. A pressure fluid actuated power plant comprising:

a housing;

a hollow shaft rotatably supported in said housing and sealably extending outward of the housing;

a plurality rotatable turbine wheels of various diameter attached to said shaft inside said housing, said turbine having a plurality of pairs of spaced blades, said space between said pair of blades communicating with an opening in the shaft to permit flow of said pressure fluid from between the blades into the hollow interior of said shaft;

nozzle means connected to said housing to selectively direct said pressure fluid into a selected turbine wheel blades to cause said rotation of said turbine wheel and exhaust said pressure fluid at a lower pressure into said hollow interior of said shaft;

means to direct said exhaust pressure fluid from said shaft to a means to reform said steam to a given pressure and to recycle said steam back to said housing.

2. The power plant of claim 1 wherein said shaft is connected to an electrical generating means.

3. The power plant of claim 1 wherein each blade of each turbine wheel is oriented at an angle of $7\frac{1}{2}°$ to the axis of said shaft.

4. The power plant of claim 1 wherein each blade in a cross-section transverse to the axis of said shaft, defines a concave curve at the outer periphery of said blade that faces the reverse direction of rotation of said turbine wheel.

* * * * *